US005350658A

United States Patent [19]

Yasuda et al.

[11] Patent Number: 5,350,658

[45] Date of Patent: Sep. 27, 1994

[54] METHOD OF FORMING FIXED IMAGES COMPRISING SIMULTANEOUS TRANSFER AND FIXING OF IMAGE

[75] Inventors: Shin-ichiro Yasuda, Osaka; Kuniyasu Kawabe; Mitsuhiro Sasaki, both of Wakayama, all of Japan

[73] Assignee: KAO Corporation, Tokyo, Japan

[21] Appl. No.: 941,324

[22] Filed: Sep. 4, 1992

[30] Foreign Application Priority Data

Sep. 7, 1991 [JP] Japan ..... 3-255764
Sep. 7, 1991 [JP] Japan ..... 3-255765

[51] Int. Cl.[5] ..... G03G 13/20

[52] U.S. Cl. ..... 430/124; 430/126; 430/97; 355/24

[58] Field of Search ..... 430/124, 138, 126, 109, 430/97; 355/23, 24

[56] References Cited

U.S. PATENT DOCUMENTS 2,952,536 9/1960 Kurz ..... 96/1
4,448,872 5/1984 Vandervalk ..... 430/126
5,225,308 7/1993 Sasaki et al. ..... 430/138

FOREIGN PATENT DOCUMENTS 2-197884 8/1990 Japan .
3-36581 2/1991 Japan .

*Primary Examiner*—Steve Rosasco
*Attorney, Agent, or Firm*—Birch, Stewart, Kolasch & Birch

[57] ABSTRACT

A method of forming fixed images including uniformly charging a photoconductor selectively exposing the photoconductor to light, developing an electrostatic latent image whereby a toner is applied to the electrostatic latent image formed on the photoconductor to form a visible image, transferring the formed visible image to a recording medium, and fixing the transferred visible image onto the recording medium, in which the toner is a thermally dissociating encapsulated toner, the photoconductor is a heat-resistant photoconductive film belt, and the transferring process and the fixing process are simultaneously carried out on the heat-resistant photoconductive film belt at a temperature of from 40° to 120° C.

12 Claims, 5 Drawing Sheets

METHOD OF FORMING FIXED IMAGES COMPRISING SIMULTANEOUS TRANSFER AND FIXING OF IMAGE

BACKGROUND OF THE INVENTION

1. Field of the Invention

The present invention relates to a method of forming fixed images used for plain paper copying machines, laser printers, plain paper facsimiles, etc. More particularly, it relates to a method of forming fixed images in which low temperature fixing is carried out using a thermally dissociating encapsulated toner.

2. Discussion of Related Art

Conventionally, when images are formed with copying machines, laser beam printers, etc., the Carlson Method has been generally used (U.S. Pat. Nos. 2,221,776, 2,297,691 and 2,357,809, "Electrophotography," p22–p41, R. M. Shaffert, 1965, The Focal Press).

FIG. 6 is a schematic view of an apparatus used in a conventional method of forming fixed images. In the conventional method of forming fixed images, after the electrostatic latent image formed on a photoconductor by optical means is developed in a developing process, it is transferred to a recording medium such as recording paper in a transfer process and then fixed into the final image generally with heat and pressure in a fixing process. As the photoconductor is repeatedly used, a cleaning device is provided for cleaning the residual toner after the transfer process during its rotation.

In the conventional method of forming fixed images, however, the processes from the formation of the electrostatic latent image up to its fixing onto the recording medium are time consuming, which makes the apparatus used therein not only complicated but also large. In addition, since the transfer efficiency of the toner is poor in the transfer process, it poses such problems as extra labor needed for the disposal of the toner collected by cleaning the residual toner, and the pollution due to the scattering of the toner in and out of the apparatus.

Specifically, in the conventional method of forming fixed images, through the processes from the formation the electrostatic latent image up to the fixing of the developed image onto the recording medium, the temperature of the heating element of the fixing device has to remain at a very high level (usually around 200° C.) and further a relatively high nip pressure is required (usually between 2.0 and 6.0 kg/cm). On the other hand, since both the photoconductor and the developing device have to be maintained at around room temperature, a considerable distance has to be maintained between the fixing device and the developing device, which necessitates making the machine larger. In addition, it is necessary to forcibly remove the generated heat from the system, but the noise produced by the forced radiation device is quite noticeable.

Therefore, a method of simultaneously conducting transferring and fixing has been proposed (U.S. Pat. No. 4,448,872). In this method, since the transferring and the fixing are simultaneously carried out by pressing the toner image developed on the dielectric drum to the recording medium, simplification of the apparatus can be achieved. However, since only pressure is applied at the fixing, the fixing ability is poor, and only little improvement is achieved in the transfer efficiency.

The fixing of the toner should be generally conducted at a high temperature due to the high melting temperature of the toner, thereby requiring an apparatus with a high thermal efficiency. The fixing process usually works independently, and is carried out at a high temperature of around 200° C. Accordingly, expensive heat-resistant materials, such as heat-resistant resins, heat-resistant rubbers, etc. have to be provided in the periphery of the fixing device.

When the fixing is carried out at a high temperature, it is subject to problems such as curling and jamming of the paper, etc. In addition, it is pointed out that fixing failure may take place due to the heat absorbed by the paper, depending upon its thickness. Further, if the fixing requires a high temperature, it takes more time to reach the set temperature so that quick printing becomes impossible. In such a case, therefore, this method is unsuitable for devices such as a facsimile which requires quick printing.

Further, in view of solving these problems, there has been proposed a method of forming fixed images, wherein the transfer and fixing process is simultaneously carried out by adhering the toner onto a transfer film, which rotates while keeping it partly in close contact with a photoconductor to form a toner image, and putting the recording paper and the transfer film between a pressure roller and a heat roller provided away from the photoconductor (Japanese Patent Laid-Open No. 197884/1990).

According to this method, however, when the transfer film is wound around the pressure roller, one of the pair of rollers for transfer and fixing, and a heat roller is arranged on the outside of the transfer film, the recording medium, which is heated from the reverse side, such as paper, etc. having an insulating effect has a poor thermal efficiency, and thus sufficient heat required for fixing cannot be supplied to the toner. Therefore, problems arise in that fixing becomes insufficient. On the other hand, when the transfer film is wound around the heat roller and the pressure roller is arranged on the outside of the transfer film, the heating material is arranged in the inside of the film belt, causing problems in radiation from the internal portion of the film belt. When the heating material is arranged inside the film belt, the radiation conditions are likely to be insufficient, thereby causing deterioration in sensitivity and decrease in durability of the photoconductor due to heat. In addition, since the fixing is carried out through the film, problems may arise in the delaying of the transmission of heat, thereby presumably demanding a higher fixing temperature for the heat roller.

Also, there has been known a method of using a photoconductive film as a photoconductor, wherein after a developing process, the transfer and fixing are carried out on the recording medium by heating the photoconductive film adhered with the toner from the reverse side (Japanese Patent Laid-Open No. 36581/1991). However, it has been pointed out that since the usual toner is used in this method, the deterioration of the photoconductive film due to heat may take place, making it unsatisfactory to meet the requirements.

From these standpoints, the development of a novel method of forming fixed images as well as a matching toner thereto is in demand.

SUMMARY OF THE INVENTION

An object of the present invention is to provide a novel method of forming fixed images, wherein a remarkable miniaturization of the fixing device can be achieved by such advantages as remarkable miniaturization of the radiator and reduction of noise due to a low fixing temperature and a low nip pressure, with extra space for collecting the toner being unnecessary due to a high transfer efficiency.

Therefore, in a view to solving the above-mentioned problems, the present inventors have investigated a toner shell material which is fragile to heat at a low temperature. As a result, they have found a thermally dissociating encapsulated toner produced by interfacial polymerization which melts at a temperature of not more than 120° C., and they have further investigated the image formation method using this encapsulated toner and have thus developed the present invention.

More particularly, the method of forming fixed images of the present invention comprises charging a photoconductor, exposing the photoconductor to light, to form an electrostatic latent image developing the electrostatic latent image whereby a toner is applied to the electrostatic latent image formed on the photoconductor to form a visible image, transferring the formed visible image to the recording medium, such as a recording paper, etc., and fixing the transferred visible image onto the recording medium, wherein the toner is a thermally dissociating encapsulated toner, the photoconductor is a heat-resistant photoconductive film belt, and the transfer process and the fixing process are simultaneously carried out on the heat-resistant photoconductive film belt at a temperature of from 40° to 120° C.

The heat-resistant photoconductive film belt is selected from the group consisting of a silicon photoconductor, a zinc oxide photoconductor dispersed in resin and an organic photoconductor, and the photoconductor comprises a binder having a glass transition point of not less than 100° C.

In addition, the transfer process and the fixing process are carried out by inserting the heat-resistant photoconductive film and the recording medium between a heat roller and a pressure roller. Alternatively, the transfer process and the fixing process are carried out by inserting the heat-resistant photoconductive film and the recording medium between two pressure rollers after preheating the toner adhered on the heat-resistant photoconductive film.

Also, a cleaning device is arranged opposite to the above heat roller or pressure roller.

According to the present invention, the visible image formed on the heat-resistant photoconductive film belt in the developing process is simultaneously transferred and fixed to the recording medium at a low temperature of from 40° to 120° C. Therefore, the transfer and fixing process can be remarkably simplified. Also, since substantially all of the toner in the developing process is transferred and fixed, there is substantially no untransferred toner present making it unnecessary to leave extra space for the residual toner. Accordingly, the overall apparatus can be remarkably miniaturized. Also, since the fixing is carried out at a low temperature, the radiator can be remarkably simplified, and thus miniaturized. Further, a cleaning device is arranged opposite to the heat roller or the pressure roller so as to remove trace amounts of the toner remaining on the heat-resistant photoconductive film belt in a molten state. Therefore, the removing efficiency of the toner is good, and the surface of the photoconductive film is not damaged. In addition, since an independent transfer process is not required, an adjustment of electric resistance for the recording medium, such as a recording paper, is also not required. By using a photoconductor having good heat resistance, the durability of the photoconductor becomes longer, thereby remarkably increasing its reliability, and the photoconductor can be miniaturized.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
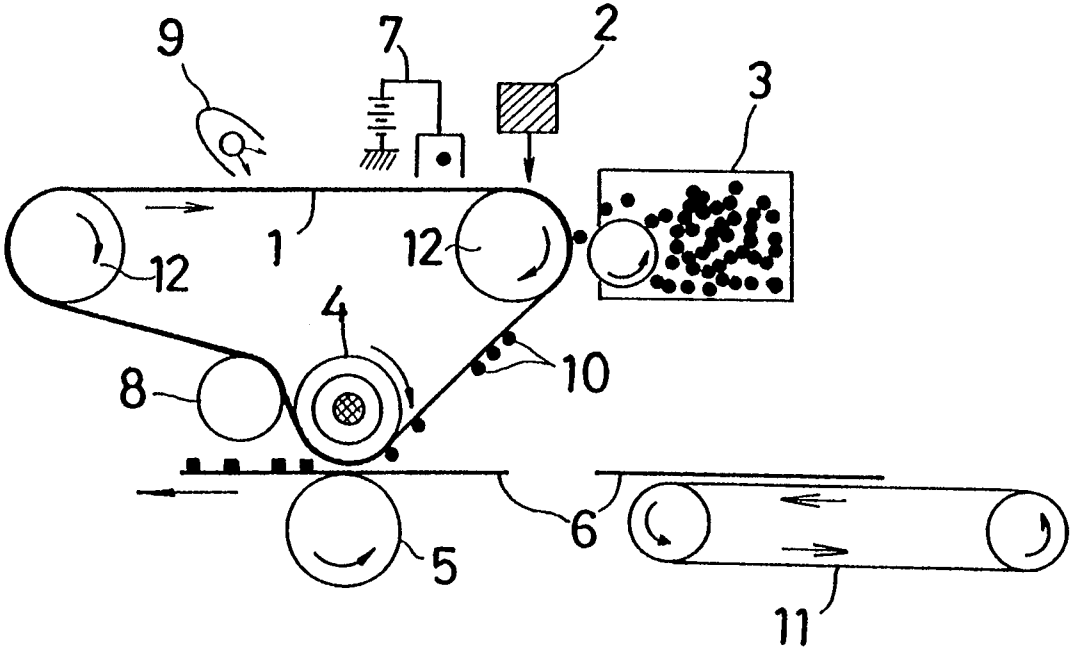
FIG. 1 is a schematic view of an apparatus used in the method of forming fixed images as defined by the present invention.

The toner used in the present invention is a thermally dissociating encapsulated toner. The encapsulated toner according to the present invention comprises a heat-fusible core containing at least a coloring agent and a shell formed thereon so as to cover the surface of the core material. In the present invention, the thermally dissociating encapsulated toner means a toner which comprises a shell whose structure is fragile to heat, and a core material which can be fixed at a low temperature by pressure. More particularly, the shell structure changes with heat and, at the point where pressure is applied, the core material is discharged to effect the fixing of the toner. Depending on the raw materials and production method, a large variety of encapsulated toners are conceivable, and as long as they are within the range of the required thermal properties, there are no limitations on what production process or materials are used. The toner in the present invention is a thermally dissociating encapsulated toner, and any toner whose fixing temperature is maintained in the range of from 40° to 120° C. to the recording medium such as a recording paper, can be properly chosen.

As to the method for producing the encapsulated toners, the following are mentioned.

(1) Spray-drying method

After the core material is dispersed in a non-aqueous solution of polymer or polymer-emulsion, the dispersed liquid is spray-dried.

(2) Phase separation method (coacervation method)

In a solution of ionic polymer colloids and the core material, phase separation is conducted around the core material. In other words, a simple emulsion is first prepared, which in turn is converted to a complex emulsion, in which the core materials are micro-encapsulated.

(3) Interfacial polymerization method

A core material solution or dispersion is dispersed in a water in oil or oil in water type emulsion system, while at the same time shell material monomers (A) are collected around the surface, where in the next step, monomers (A) and monomers (B) react as described below.

(4) Other methods include an in-situ polymerization method, a submerged cure coating method, an air suspension coating method, an electrostatic coalescing method, and a vacuum vapor deposition coating method.

The particularly preferred toners include those produced by the interfacial polymerization method and the spray-drying method. While the spray-drying method has the merits of an easy function separation for the core material and shell material and a large choice of shell materials, the interfacial polymerization method not only has the merit of an easy function separation for the core material and shell material but also is capable of producing a uniform toner in an aqueous state. Moreover, substances of low softening points can be used for the core material in the interfacial polymerization method, making it particularly suitable from the aspect of fixing ability. Accordingly, in the present invention, the thermally dissociating encapsulated toner produced by the interfacial polymerization method among others is particularly preferred.

For shell materials, styrene resins (Japanese Patent Laid-Open No. 205162/1983), polyamide resins (Japanese Patent Laid-Open No. 66948/1983), epoxy resins (Japanese Patent Laid-Open No. 148066/1984), polyurethane resins (Japanese Patent Laid-Open No. 179860/1982), polyurea resins (Japanese Patent Laid-Open No. 150262/1987) and many others have been proposed. As substances fixable under heat and pressure contained in the core material, thermoplastic resins such as polyester resins, polyamide resins, polyester-polyamide resins, and vinyl resins having glass transition points (Tg) of not less than 10° C. and not more than 50° C. can be used.

As compared to the thermal properties of the core material, the structure and the thermal properties of the shell material concern themselves remarkably with the fixing ability of the entire toner. Since a particular polyurethane resin among the above-mentioned resins for the shell materials is thermally dissociating, having excellent storage stability and fixing ability at a low temperature, it is an extremely favorable material for the method of forming fixed images of the present invention. As principal components of such a shell material, resins obtainable from the reaction between an isocyanate compound and/or isothiocyanate compound and compounds containing a phenolic hydroxy group and/or a thiol group are preferably used (EP04538-57A).

The thermally dissociating encapsulated toner suitably used in the present invention can be produced by any known method such as interfacial polymerization, etc., and this encapsulated toner is composed of a heat-fusible core material containing at least a coloring agent and a shell formed thereon so as to cover the surface of the core material, wherein the main components of the shell are a resin prepared by reacting:

(A) an isocyanate and/or isothiocyanate compound comprising:

(1) 0 to 30 mol % of a monovalent isocyanate and/or isothiocyanate compounds, and (2) 100 to 70 mol % of at least a divalent isocyanate and/or isothiocyanate compounds with (B) an active hydrogen compound comprising:

(3) 0 to 30 mol % of a compound having one active hydrogen atom reactive with the isocyanate and/or isothiocyanate groups and (4) 100 to 70 mol % of a compound having at least two active hydrogen atoms reactive with the isocyanate and/or isothiocyanate groups at a molar ratio of the component (A) to the component (B) of between 1:1 and 1:20, and wherein at least 30% of all of the linkages formed from the isocyanate or isothiocyanate groups are thermally dissociating linkages.

According to the present invention, the thermally dissociating linkage is preferably one formed by the reaction between a phenolic hydroxyl and/or thiol group and an isocyanate and/or isothiocyanate group.

Examples of the monovalent isocyanate compounds to be used as the component (1) in the present invention include ethyl isocyanate, octyl isocyanate, 2-chloroethyl isocyanate, chlorosulfonyl isocyanate, cyclohexyl isocyanate, n-dodecyl isocyanate, butyl isocyanate, n-hexyl isocyanate, lauryl isocyanate, phenyl isocyanate, m-chlorophenyl isocyanate, 4-chlorophenyl isocyanate, p-cyanophenyl isocyanate, 3,4-dichlorophenyl isocyanate, o-tolyl isocyanate, m-tolyl isocyanate, p-tolyl isocyanate, p-toluenesulfonyl isocyanate, 1-naphthyl isocyanate, o-nitrophenyl isocyanate, m-nitrophenyl isocyanate, p-nitrophenyl isocyanate, p-bromophenyl isocyanate, o-methoxyphenyl isocyanate, m-methoxyphenyl isocyanate, p-methoxyphenyl isocyanate, ethyl isocyanatoacetate, butyl isocyanatoacetate and trichloroacetyl isocyanate.

Examples of the divalent or higher isocyanate compounds to be used as the component (2) in the present invention include aromatic isocyanate compounds such as 2,4-tolylene diisocyanate, 2,4-tolylene diisocyanate dimer, 2,6-tolylene diisocyanate, p-xylylene diisocyanate, m-xylylene diisocyanate, 4,4'-diphenylmethane diisocyanate, 1,5-naphthylene diisocyanate, 3,3'-dimethyldiphenyl-4,4'-diisocyanate, 3,3'-dimethyldiphenylmethane-4,4'-diisocyanate, m-phenylene diisocyanate, triphenylmethane triisocyanate and polymethylenephenyl isocyanate; aliphatic isocyanate compounds such as hexamethylene diisocyanate, trimethylhexamethylene diisocyanate, lysine diisocyanate and dimer acid diisocyanates; alicyclic isocyanate compounds such as isophorone diisocyanate, 4,4'-methylenebis-(cyclohexyl isocyanate), methylcyclohexane-2,4(or 2,6)-diisocyanate and 1,3-(isocyanatomethyl)cyclohexane; and other isocyanate compounds such as an adduct of 1 mol of trimethylolpropane with 3 mol of tolylene diisocyanate.

Examples of the isothiocyanate compounds include phenyl isothiocyanate, xylylene-1,4-diisothiocyanate and ethylidene diisothiocyanate.

Among these isocyanate and isothiocyanate compounds, compounds having an isocyanate group directly bonded to an aromatic ring are preferred, because they are effective in forming a urethane resin having a low thermal dissociation temperature.

According to the present invention, the monovalent isocyanate and/or isothiocyanate compound (1) also serves as a molecular weight modifier for the shell-forming resin and can be used in an amount of at most 30 mol % based on the isocyanate component and/or the isothiocyanate component. When the amount exceeds 30 mol %, the storage stability of the obtained encapsulated toner is undesirably poor.

Examples of compounds having one active hydrogen atom reactive with isocyanate and/or isothiocyanate groups to be used as component (3) in the present invention include aliphatic alcohols such as methyl alcohol, ethyl alcohol, propyl alcohol, isopropyl alcohol, butyl alcohol, isobutyl alcohol, tert-butyl alcohol, pentyl alcohol, hexyl alcohol, cyclohexyl alcohol, heptyl alcohol, octyl alcohol, nonyl alcohol, decyl alcohol, lauryl alcohol and stearyl alcohol; aromatic alcohols such as phenol, o-cresol, m-cresol, p-cresol, 4-butylphenol, 2-sec-butylphenol, 2-tert-butylphenol, 3-tert-butylphenol, 4-tert-butylphenol, nonylphenol, isononylphenol, 2-propenylphenol, 3-propenylphenol, 4-propenylphenol, 2-methoxyphenol, 3-methoxyphenol, 4-methoxyphenol, 3-acetylphenol, 3-carbomethoxyphenol, 2-chlorophenol, 3-chlorophenol, 4-chlorophenol, 2-bromophenol, 3-bromophenol, 4-bromophenol, benzyl alcohol, 1-naphthol, 2-naphthol and 2-acetyl-1-naphthol; and amides such as ϵ-caprolactam.

Particularly, a phenol derivative represented by the following formula (I) is preferably used:

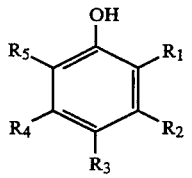

(I)

wherein $R_1$, $R_2$, $R_3$, $R_4$ and $R_5$ each independently represents a hydrogen atom, an alkyl group having 1 to 9 carbon atoms, an alkenyl, alkoxy, alkanoyl, carboalkoxy or aryl group or a halogen atom.

Examples of the dihydric or higher alcohols among the compounds having at least two active hydrogen atoms reactive with isocyanate and/or isothiocyanate groups to be used as the component (4) in the present invention include catechol, resorcinol, hydroquinone, 4-methylcatechol, 4-tert-butylcatechol, 4-acetylcatechol, 3-methoxycatechol, 4-phenylcatechol, 4-methylresorcinol, 4-ethylresorcinol, 4-tert-butylresorcinol, 4-hexylresorcinol, 4-chlororesorcinol, 4-benzylresorcinol, 4-acetylresorcinol, 4-carbomethoxyresorcinol, 2-methylresorcinol, 5-methylresorcinol, tert-butylhydroquinone, 2,5-di-tert-butylhydroquinone, 2,5-di-tert-amylhydroquinone, tetramethylhydroquinone, tetrachlorohydroquinone, methylcarboaminohydroquinone, methylureidohydroquinone, benzonorbornene-3,6-diol, bisphenol A, bisphenol S, 3,3'-dichlorobisphenol S, 2,2'-dihydroxybenzophenone, 2,4-dihydroxybenzophenone, 4,4'-dihydroxybenzophenone, 2,2'-dihydroxydiphenyl, 4,4'-dihydroxydiphenyl, 2,2'-dihydroxydiphenylmethane, 3,4-bis(p-hydroxyphenyl)hexane, 1,4-bis(2-(p-hydroxyphenyl)propyl)benzene, bis(4-hydroxyphenyl)methylamine, 1,3-dihydroxynaphthalene, 1,4-dihydroxynaphthalene, 1,5-dihydroxynaphthalene, 2,6-dihydroxynaphthalene, 1,5-dihydroxyanthraquinone, 2-hydroxybenzyl alcohol, 4-hydroxybenzyl alcohol, 2-hydroxy-3,5-di-tert-butylbenzyl alcohol, 4-hydroxy-3,5-di-tert-butylbenzyl alcohol, 4-hydroxyphenethyl alcohol, 2-hydroxyethyl 4-hydroxybenzoate, 2-hydroxyethyl 4-hydroxyphenylacetate, resorcinol mono-2-hydroxyethyl ether, hydroxyhydroquinone, gallic acid and ethyl 3,4,5-trihydroxybenzoate.

Among these dihydric or higher alcohols, catechol derivatives represented by the following formula (II) and resorcinol derivatives represented by the following formula (III) are preferably used:

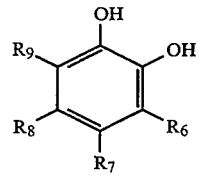

(II)

wherein $R_6$, $R_7$, $R_8$ and $R_9$ each independently represents a hydrogen atom, an alkyl group having 1 to 6 carbon atoms, an alkenyl, alkoxy, alkanoyl, carboalkoxy or aryl group or a halogen atom.

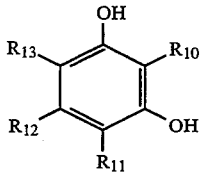

(III)

wherein $R_{10}$, $R_{11}$, $R_{12}$ and $R_{13}$ each independently represents a hydrogen atom, an alkyl group having 1 to 6 carbon atoms, an alkenyl, alkoxy, alkanoyl, carboalkoxy or aryl group or a halogen atom.

Further, examples of the compounds having at least one isocyanate- or isothiocyanate-reactive functional group other than the hydroxyl group and at least one phenolic hydroxyl group include o-hydroxybenzoic acid, m-hydroxybenzoic acid, p-hydroxybenzoic acid, 5-bromo-2-hydroxybenzoic acid, 3-chloro-4-hydroxybenzoic acid, 4-chloro-2-hydroxybenzoic acid, 5-chloro-2-hydroxybenzoic acid, 3,5-dichloro-4-hydroxybenzoic acid, 3-methyl-2-hydroxybenzoic acid, 5-methoxy-2-hydroxybenzoic acid, 3,5-di-tert-butyl-4-hydroxybenzoic acid, 4-amino-2-hydroxybenzoic acid, 5-amino-2-hydroxybenzoic acid, 2,5-dinitrosalicylic acid, sulfosalicylic acid, 4-hydroxy-3-methoxyphenylacetic acid, catechol-4-carboxylic acid, 2,4-dihydroxybenzoic acid, 2,5-dihydroxybenzoic acid, 2,6-dihydroxybenzoic acid, 3,4-dihydroxybenzoic acid, 3,5-dihydroxybenzoic acid, 3,4-dihydroxyphenylacetic acid, m-hydroxycinnamic acid, p-hydroxycinnamic acid, 2-amino-4-methylphenol, 2-amino-5-methylphenol, 5-amino-2-methylphenol, 3-amino-2-naphthol, 8-amino-2-naphthol, 1-amino-2-naphthol-4-sulfonic acid, 2-amino-5-naphthol-4-sulfonic acid, 2-amino-4-nitrophenol, 4-amino-2-nitrophenol, 4-amino-2,6-dichlorophenol, o-aminophenol, m-aminophenol, p-aminophenol, 4-chloro-2-aminophenol, 1-amino-4-hydroxyanthraquinone, 5-chloro-2-hydroxyaniline, α-cyano-3-hydroxycinnamic acid, α-cyano-4-hydroxycinnamic acid, 1-hydroxynaphthoic acid, 2-hydroxynaphthoic acid, 3-hydroxynaphthoic acid and 4-hydroxyphthalic acid.

Further, examples of the polythiol compounds having at least one thiol group in each molecule include ethanethiol, 1-propanethiol, 2-propanethiol, thiophenol, bis(2-mercaptoethyl)ether, 1,2-ethanedithiol, 1,4-butanedithiol, bis(2-mercaptoethyl) sulfide, ethylene glycol bis(2-mercaptoacetate), ethylene glycol bis(3-mercaptopropionate), 2,2-dimethylpropanediol bis(2-mercaptoacetate), 2,2-dimethylpropanediol bis(3-mercaptopropionate), trimethylolpropane tris(2-mercaptoacetate), trimethylolpropane tris(3-mercaptopropionate), trimethylolethane tris(2-mercaptoacetate), trimethylolethane tris(3-mercaptopropionate), pentaerythritol tetrakis(2-mercaptoacetate), pentaerythritol tetrakis(3-mercaptopropionate), dipentaerythritol hexakis(2-mercaptoacetate), dipentaerythritol hexakis(3-mercaptopropionate), 1,2-dimercaptobenzene, 4-methyl-1,2-dimercaptobenzene, 3,6-dichloro-1,2-dimercaptobenzene, 3,4,5,6-tetrachloro-1,2-dimercaptobenzene, xylylenedithiol and 1,3,5-tris(3-mercaptopropyl) isocyanurate.

In the thermally dissociating shell-forming resin used in the present invention, at least 30%, preferably at least 50% of all of the linkages formed from isocyanate or isothiocyanate groups are thermally dissociating linkages. When the content of the thermally dissociating linkages is less than 30%, the strength of the shell in the heat-and-pressure fixing cannot be sufficiently lowered, making less likely to exhibit any advantageous fixing performance of the core material.

In the thermally dissociating encapsulated toner of the present invention, other compounds having an isocyanate-reactive functional group other than phenolic hydroxyl and thiol groups, which may be used as a shell-forming material in such an amount as not to lower the ratio of the linkages formed by the reaction of isocyanate and/or isothiocyanate groups with phenolic hydroxyl and/or thiol groups to the all of the linkages formed from isocyanate and/or isothiocyanate groups is less than 30%, include, for example, the following active methylene compounds such as malonate and acetoacetate, oxime such as methyl ethyl ketone oxime, carboxylic acid, polyol, polyamine, aminocarboxylic acid and aminoalcohol.

According to the present invention, the compound having one active hydrogen atom reactive with isocyanate and/or isothiocyanate groups as the component (3) may be used in an amount of at most 30 mol % based on the active hydrogen component. When the amount exceeds 30 mol %, the storage stability of the resulting toner is undesirably poor.

Further, the molar ratio of (A) the isocyanate compound and/or isothiocyanate compound comprising the components (1) and (2) to (B) the active hydrogen compounds comprising the components (3) and (4) preferably lies between 1:1 and 1:20 in order to obtain a resin free from unreacted isocyanate groups.

In the production of the encapsulated toner according to the present invention, the shell is preferably formed by an interfacial polymerization or an in-situ polymerization. Alternatively, it may be formed by a dry method comprising stirring in an air stream at a high rate matrix particles used as a core material together with particles used as a shell-forming material having a number-average particle size of one-eighth or less of that of the matrix particles.

The resins to be used as the shell materials can be produced in the presence of no catalysts. However when the resins are produced in the presence of catalysts, those catalysts including tin catalysts such as dibutyltindilaurate, etc., amine catalysts such as 1,4-diazabicyclo[2.2.2]octane, N,N,N-tris-(dimethylaminopropyl)-hexahydro-S-triazine, etc. and any known urethane catalysts can be used.

The resins to be used as core materials of the encapsulated toner according to the present invention are thermoplastic resins having glass transition points (Tg) of 10° to 50° C., and examples thereof include polyester resins, polyester-polyamide resins, polyamide resins and vinyl resins, among which vinyl resins are particularly preferable. When the glass transition point (Tg) is less than 10° C., the storage stability of the resulting encapsulated toner is undesirably poor, and when it exceeds 50° C., the fixing strength of the encapsulated toner is undesirably poor.

Examples of the monomers constituting the vinyl resins include styrene and its derivatives such as styrene, o-methylstyrene, m-methylstyrene, p-methylstyrene, α-methylstyrene, p-ethylstyrene, 2,4-dimethylstyrene, p-chlorostyrene and vinylnaphthalene; ethylenically unsaturated monoolefins such as ethylene, propylene, butylene and isobutylene; vinyl esters such as vinyl chloride, vinyl bromide, vinyl fluoride, vinyl acetate, vinyl propionate, vinyl formate and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate and diethylaminoethyl methacrylate; ethylenic monocarboxylic acid derivatives such as acrylonitrile, methacrylonitrile and acrylamide; ethylenic dicarboxylic acids and derivatives thereof such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the above core material resin-constituting monomers according to the present invention, the core material-forming resin contains, in the main skeleton of the resin, styrene or its derivatives preferably in an amount of 50 to 90 parts by weight, and the ethylenic monocarboxylic acid or an ester thereof preferably in an amount of 10 to 50 parts by weight to control the thermal properties of the resin, such as the softening point.

When the monomer composition constituting the core material-forming resin according to the present invention contains a crosslinking agent, which may be also used, if necessary, as a mixture of two or more of them, any known crosslinking agents may be properly used. When the amount of the crosslinking agent added is too large, the resulting toner is less likely to be heat-fused, thereby resulting in poor heat fixing ability and heat-and-pressure fixing ability. On the contrary, when the amount is too small, in heat-and-pressure fixing, a part of the toner cannot be completely fixed on a paper but rather adheres to the surface of a roller, which in turn is transferred to a subsequent paper which creates the so-called "offset" or "offset phenomenon." Accordingly, the amount of the crosslinking agent is preferably 0.001 to 15% by weight, more preferably 0.1 to 10% by weight, based on the monomers used.

The core material of the thermally dissociating encapsulated toner according to the present invention may further contain, if necessary, one or more offset inhibitors of any known kind for the purpose of improving offset resistance at heat-and-pressure fixing. These offset inhibitors are contained in an amount of 1 to 20% by weight based on the resin contained in the core material.

The core material of the thermally dissociating encapsulated toner according to the present invention contains a coloring agent, which may be any one of the dyes and pigments used in the conventional toners. The coloring agent is generally contained in an amount of 1 to 15 parts by weight per 100 parts by weight of the resin contained in the core material.

In addition, in the shell-forming materials of the thermally dissociating encapsulated toner according to the present invention and in the core material, a metal-containing dye which has been used for toners, for example, a metal complex of an organic compound having a carboxyl or nitrogenous group, such as nigrosine, may be added in an effective amount as a charge control agent. Alternatively, such a charge control agent may be mixed with the toner.

The thermally dissociating encapsulated toner according to the present invention may contain, if necessary, a fluidity improver and/or a cleanability improver. Further, for the purpose of controlling the developability of the encapsulated toner, an additive, for example, finely powdered polymethyl methacrylate, etc. may be added. Furthermore, for the purposes of toning or resistance control, a small amount of carbon black may be used.

The thermally dissociating encapsulated toner of the present invention preferably has a softening point of not less than 80° C. and not more than 150° C. If the softening point is lower than 80° C., the offset resistance of the resulting encapsulated toner is undesirably poor, and when it exceeds 150° C., the fixing strength of the encapsulated toner is undesirably poor.

Although the particle size of the encapsulated toner according to the present invention is not particularly limited, the average particle size thereof is generally 3 to 30 μm. The preferred thickness of the shell of the encapsulated toner is from 0.01 to 1 μm. When the thickness is less than 0.01 μm, the blocking resistance of the resulting encapsulated toner is poor, and when it exceeds 1 μm, the heat fusibility of the resulting encapsulated toner is undesirably poor.

Examples of the thermally dissociating encapsulated toners which are preferably used in the present invention are described above, but the present invention is not confined to these alone The method of forming fixed images of the present invention are detailed below, referring to the drawings. FIG. 1 is a schematic view of an apparatus used for the method of forming fixed images by using a heat roller and a pressure roller in the transfer process and the fixing process as defined by the present invention.

In FIG. 1 there is seen a heat-resistant photoconductive film belt 1. For photoconductors, those practically useful are photoconductors of selenium, silicon, and organic groups. However, in the present invention, since the photoconductor is exposed to a considerable amount of heat, the silicon photoconductors, the zinc oxide resin-dispersed photoconductors and the organic photoconductors having good heat resistance are preferred. In the present invention, these photoconductors are used in the form of a film belt.

A silicon photoconductor is composed of amorphous silicon or silicon carbide (Japanese Patent Laid-Open No. 86341/1979), and for example, the p-type photoconductor to which boron atoms are doped to the amorphous silicon or the n-type photoconductor to which phosphorus atoms are doped to the amorphous silicon can be used.

As zinc oxide resin-dispersed photoconductors, those having a photoconductive layer comprising zinc oxide fine particles, sensitizer dyes and binders can be used (U.S. Pat. No. 2,952,536). From the viewpoint not only in the sensitivity but also in the chargeability of the photoconductor, the zinc oxide fine particles preferably have a particle size of 0.1 to 1 μm. The sensitizer dyes are appropriately chosen in accordance with the wavelength of the light source in the exposure device. Examples thereof include xanthene dyes such as Rose Bengal, etc., triphenylmethane dyes such as Crystal Violet, etc., thiazine dyes such as Methylene Blue, etc. and cyanine dyes.

The organic photoconductors are single-layered or laminated photoconductor having a photoconductive layer comprising materials capable of generating charges and transporting charges and binders on the conductive supporter can be used. Examples of the charge generation materials include perylene pigments, condensed ring quinone pigments, phthalocyanine pigments, bisazo pigments, trisazo pigments, squarylium pigments, etc., with preference given to the perylene pigments and phthalocyanine pigments. Examples of the charge transport materials include hydrazone derivatives, pyrazoline derivatives, oxadiazole derivatives, arylamine derivatives, styrile derivatives, etc., with preference given to the arylamine derivatives.

The binders which can be preferably used for the heat-resistant photoconductive film belts in the present invention have glass transition points of not less than 100° C. Typical examples thereof include condensation polymers such as polycarbonates, polyarylates, polyesters, polyamides, etc.; addition polymers such as polymethacrylate, styrene-methacrylate copolymer, polyacetal, etc.; and thermosetting resins such as epoxy resins, phenol resins, silicone resins, urethane resins, urea resins, etc. When the above binders are used, those having glass transition points of less than 100° C. are undesirable because the adhesion of the toner and the blur of the latent image take place.

Any of the above photoconductors can be used as the heat-resistant photoconductive film belts for the present invention, as long as its photoconductive layer has a glass transition point of normally not less than 100° C. to meet the requirement in heat resistance.

A charger 7 is located opposite to the heat-resistant photoconductive film belt 1. The charging means is not particularly restricted, and any of, for example, a corona charger, a brush charger, etc. can be used.

An exposure device 2 is located opposite to the heat-resistant photoconductive film belt 1 for forming electrostatic latent images on the surface of the photoconductive film. For an exposure device 2, light sources such as laser beams, LED or EL arrays, etc. are used in combination with an image-forming optical system. Alternatively, a device based on optical systems projecting a reflected light of a document usually provided in the copying machine can be used.

A developer device 3 is located opposite to the heat-resistant photoconductive film belt 1 for making visible the electrostatic latent image formed on the surface of the photoconductive film with the toner. For a developer device, any of the commonly used two-component magnetic brush developer devices, the one-component magnetic brush developer device, and the one-component non-magnetic developer device, etc. can be used.

The visible image formed on the heat-resistant photoconductive film belt in the developing process is conveyed to the fixing portion after the developing process along the movement of the heat-resistant photoconductive film belt, which is rotated by specific driving means not illustrated in the figure in the direction shown in the figure at specified peripheral speeds.

On the other hand, as shown in FIG. 1, the recording medium 6, such as a recording paper, etc. is conveyed to the fixing station by conveying means such as a conveyor belt 11 shown in the figure, synchronizing with the initial end of the visible image.

The fixing portion comprises a heat roller 4 and a pressure roller 5. When a heat roller is used for fixing, in the case of a conventional device, heat-resistant resins such as of fluoro-resins, polyimide resins, polyamide resins, polyamide-imide resins, etc. are used. In the present invention, since fixing is carried out at a low temperature, the use of conventional heat-resistant films makes the durability of the heat roller longer. In addition, non-heat-resistant films such as those of polyester resins, polypropylene resins, polyethylene resins, etc. and cellophane can be used.

The pressure roller 5 transfers and fixes the visible image by pressure-welding the recording medium onto the surface of the heat-resistant photoconductive film belt on which the visible image is formed. In a conventional fixing device, since the fixing is carried out at a high temperature, a heat-resistant silicone rubber must be used for the pressure roller. However, in the present invention, the temperature transmitted to the pressure roller is very low. Therefore, a high heat resistance is not required for the pressure roller. Accordingly, as long as it is an elastic member having a softening point of not less than 120° C., there are no limitations on its material, and any of the ordinary inexpensive elastic materials can be used. Further, since such a low nip pressure as less than 4 kg/cm is applicable to a fixing device in the present invention, the durability of the fixing roller becomes longer.

In the present invention, the transfer and the fixing are simultaneously carried out by inserting the heat-resistant photoconductive film belt and the recording medium between the heat roller 4 and the pressure roller 5. Specifically, the toner adhered to the heat-resistant photoconductive film belt is heated to a temperature range of normally 40° to 120° C. by the heat roller 4, and pressure-welded onto the surface of the recording medium 6, such as a recording paper, by passing the heat-resistant photoconductive film belt and the recording medium 6 between the heat roller 4 and the pressure roller 5, thereby the transfer and fixing are simultaneously carried out.

In this case, when the heating temperature by means of a heat roller 4 is less than 40° C., the melting of the toner becomes insufficient, and when it exceeds 120° C., the fixing temperature becomes too high, posing problems incurred by the conventional methods as mentioned above.

In the case of the conventional methods, the nip pressure in the fixing has to be made higher, if the fixing temperature is made lower, thereby requiring a nip pressure of usually not less than 4 kg/cm. However, in the present invention, although the fixing temperature is set to be not more than 120° C., a sufficient fixing strength can be obtained with a nip pressure of normally 0.1 to 4 kg/cm, and even less than 2 kg/cm in many cases. For the reasons mentioned above, since the transfer and the fixing can be simultaneously carried out, and the fixing is carried out at a low nip pressure, a high quality image can be obtained because the spots on the visible images due to the scattering of the toner, the low line resolution and the blur of the visible images are not likely to take place. In addition, since the toner has an extremely high transfer efficiency to the paper, the production of disposed or residual toner is not likely to take place.

A cleaner device 8 such as a cleaning web, etc. can be arranged so as to remove the trace amounts of the toner remaining on the heat-resistant photoconductive film belt 1 after the transfer and fixing process. In this case, the cleaner device 8 is preferably arranged opposite to the heat roller 4 so that the toner can be removed in a molten state. By such an arrangement, the removing efficiency of the residual toner becomes high, and the surface of the photoconductive film is not likely to be damaged.

As shown in FIG. 1, the heat-resistant photoconductive film belt 1 is stretched with at least one holding roller 12 and a heater roller 4, and the number of rollers is not particularly limitative thereto.

The heat roller 4, the pressure roller 5, the holding roller(s) 12 and the conveyor belt 11 are rotated by specified driving means not illustrated in the figure in the direction shown by the arrow in FIG. 1 at specified peripheral speeds. As a result, the heat-resistant photoconductive film belt 1 moves in the direction shown by the arrow in the figure. After the completion of the charging process, the exposure process, the developing process and the transfer and fixing process, the charges remaining on the heat-resistant photoconductive film belt 1 are neutralized by a charge eraser 9 such as a charge erasing lamp into a reusable state again for the charging process.

After transferring and fixing the toner in an image-wise configuration onto the recording medium 6 as described above, the recording medium 6 is discharged out of the apparatus by a paper discharging means not illustrated in the figure.

Figure 2:
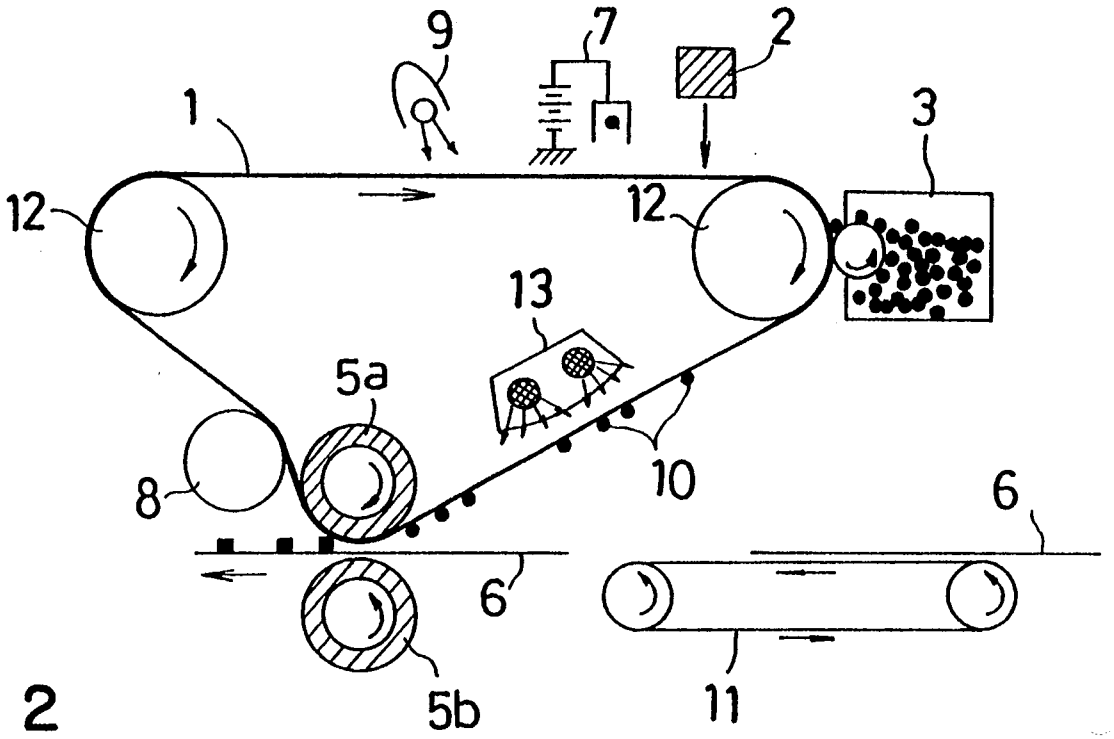
FIG. 2 is a schematic view of an alternate embodiment of the apparatus used in the method of forming fixed images as defined by the present invention.

Next, a view of an alternate apparatus used for a method of forming fixed images as defined by the present invention is schematically shown in FIG. 2, wherein after preheating the toner adhered onto the heat-resistant photoconductive film belt, the heat-resistant photoconductive film belt and the recording medium are inserted between two pressure rollers in the simultaneous transfer and the fixing process.

The charging process, the exposing process and the developing process are carried out in the same manner as illustrated in FIG. 1. After the developing process, the visible image formed on the heat-resistant photoconductive film belt is conveyed to the fixing portion along the movement of the heat-resistant photoconductive film belt in the same manner as in FIG. 1, which is rotated by specific driving means not illustrated in the figure in the direction shown in the figure at specified peripheral speeds. On the other hand, in the same manner as in FIG. 1, the recording medium 6 such a recording paper, is conveyed to the pair of pressure rollers 5*a*, 5*b*, which are assigned at the transfer and the fixing station, by conveying means such as a conveyor belt 11 shown in the figure, synchronizing with the initial end of the visible image.

The toner adhered onto this heat-resistant photoconductive film belt is heated in advance by a heating means 13 for preheating the toner while conveying to be processed to an extent that the shell of the encapsulated toner can be easily dissociated. Specifically, the heating means according to the present invention is arranged opposite to the heat-resistant photoconductive film belt at the inner surface side of the heat-resistant photoconductive film belt, and a heating element which can preheat the toner surface from the reverse side of the moving heat-resistant photoconductive film belt to a temperature range of 40° to 120° C. can be used therefor. When the heating temperature is less than 40° C., the melting of the toner becomes undesirably insufficient, and when it exceeds 120° C., the fixing temperature becomes too high, posing problems incurred by the conventional methods as mentioned above.

In general, when the surface temperature of the heat-resistant photoconductive film belt is too high, the fixing temperature becomes high, resulting in the curling of the recording paper, and when it is too low, the fixing of the toner becomes insufficient, resulting in poor recording storage ability. In the present invention, however, since the fixing can be carried out at a temperature of 40° C. to 120° C. as described above, such problems are not likely to take place.

As long as it is a device capable of heating the surface of the heat-resistant photoconductive film belt up to 120° C., any type of the heater 13 including, for example, a hot plate, a quartz heater lamp, a flash lamp, a heating belt, a heater element, etc. can be used as a heating element, with preference given to the quartz heater lamp and the heater element.

Next, as means for transferring and fixing the toner thus preheated onto the recording medium, the pressure rollers can be used. In this embodiment, the transfer and the fixing are simultaneously carried out by inserting the recording medium 6 together with the heat-resistant photoconductive film belt 1 between the pair of the pressure rollers 5*a*, 5*b*. Specifically, the pressure roller 5*a* and the pressure roller 5*b* are means for simultaneously transferring and fixing the visible image formed on the heat-resistant photoconductive film belt by pressing the visible image onto the surface of the recording medium. In a conventional fixing method, since the fixing is carried out at a high temperature, a heat-resistant silicone rubber, etc. must be used for the pressure roller. However, in the present invention, the temperature transmitted to the pressure roller is very low. Therefore, a high heat resistance is not required for the pressure roller. Accordingly, as long as it is an elastic member having a softening point of not less than 120° C., there are no other limitations on its material, and any of the ordinary inexpensive elastic materials can be used.

Further, in this embodiment, since the nip pressure by the pressure rollers is usually as low as 0.1 to 4 kg/cm, as in FIG. 1, the durability of the pressure roller becomes long. In the case of the conventional methods, the nip pressure at the fixing has to be made higher, if the fixing temperature is made lower, thereby requiring a nip pressure of usually not less than 4 kg/cm. However, according to the present invention, although the fixing temperature is set to be not more than 120° C. as described above, a sufficient fixing strength can be obtained with a nip pressure of normally less than 4 kg/cm, and even less than 2 kg/cm in many cases.

In the method of forming fixed images of the present invention, after transferring and fixing the toner by pressing the recording medium to the heat-resistant photoconductive film belt with the pair of the pressure rollers 5*a*, 5*b*, a cleaning device 8 can be arranged, which also functions to cool the heat-resistant photoconductive film belt 1, so as to remove the trace amounts of toner remaining on the heat-resistant photoconductive film belt after the transfer and fixing process. In this case, the cleaning device 8 exemplified by a cleaning web is preferably arranged adjacent or opposite to the pressure roller 5*a* so that the toner can be removed in a molten state.

As shown in FIG. 2, the heat-resistant photoconductive film belt 1 is stretched with at least holding rollers 12 and a pressure roller 5*a* in the same manner as in FIG. 1, and the number of rollers is not particularly limitative thereto.

The pair of pressure rollers 5*a*, 5*b*, the holding rollers 12 and the conveyor belt 11 are rotated by specified driving means not illustrated in the figure in the direction shown by the arrow in FIG. 2 at specified peripheral speeds. As a result, the heat-resistant photoconductive film belt 1 moves in the direction shown by the arrow in the figure. After the completion of the charging process, the exposure process, the developing process and the transfer and fixing process, the charges remaining on the heat-resistant photoconductive film belt 1 are neutralized by a charge eraser 9, such as a charge erasing lamp, into a reusable state again for the charging process.

After transferring and fixing the toner onto the recording medium 6 as described above, the recording medium 6 is discharged out of the apparatus by a paper discharging means not illustrated in the figure.

Next, the individual process steps of the method of forming fixed images by the present invention having the above-mentioned construction will be described.

Figure 3:
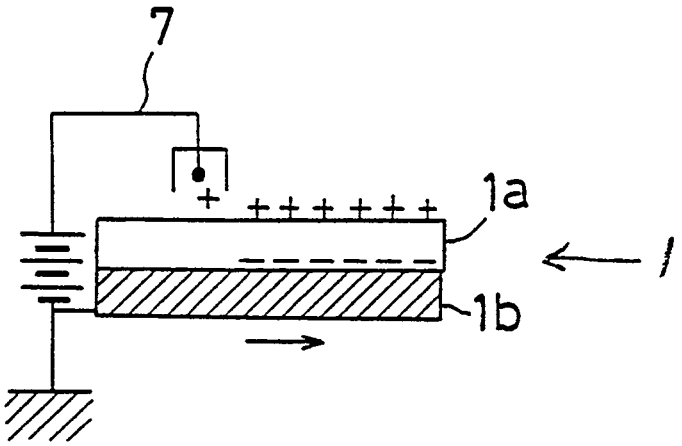
FIG. 3 is a schematic view showing the charging process in the method as defined by the present invention.

In the charging process, as shown in FIG. 3, a specified charge is uniformly supplied, e.g. by the corona charger 7, to the surface of the photoconductive film. In this example, the surface of the conductive support 1*b* is coated with the photoconductive layer 1*a* to form the endless heat-resistant photoconductive film belt 1. A high voltage is applied by the corona charger 7 to the photoconductive layer 1*a*, thereby positively charging the surface of the photoconductive layer 1*a*.

Figure 4:
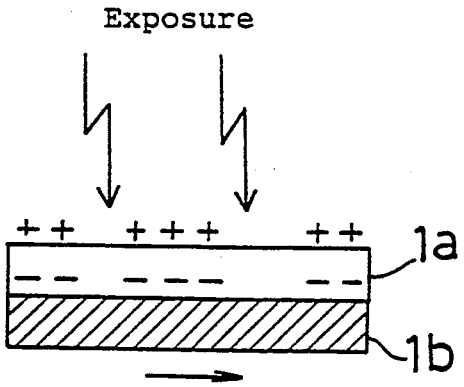
FIG. 4 is a schematic view showing the exposing process in the method as defined by the present invention.

In the exposing process, as shown in FIG. 4, a light from the exposure device 2 is selectively irradiated to the surface of the above heat-resistant photoconductive film belt 1, so that a leakage of charges occurs only in the exposed parts to form an electrostatic latent image on the photoconductive layer 1*a*.

Figure 5:
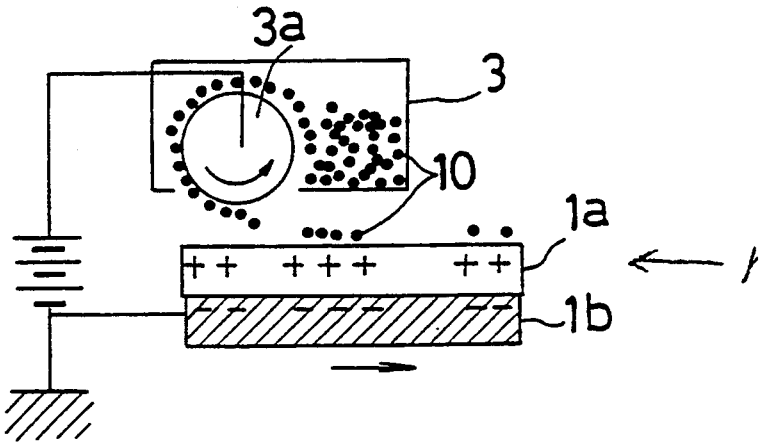
FIG. 5 is a schematic view showing the developing process in the method as defined by the present invention.
Figure 6:
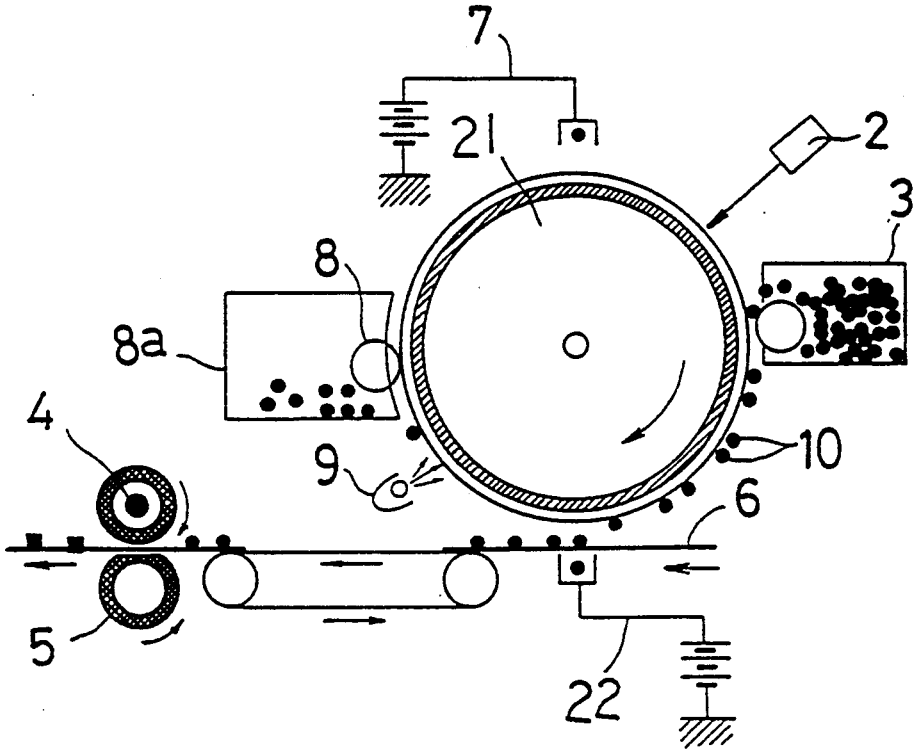
FIG. 6 PRIOR ART
FIG. 6 is a schematic view of an apparatus used in a conventional method of forming fixed images.

In the developing process, as shown in FIG. 5, the toner 10 triboelectrically charged inside the developer device 3 is transported by the rotating sleeve 3*a*, and developed onto the surface of the heat-resistant photoconductive film belt 1 in proportion to the charge on the surface of the heat-resistant photoconductive film belt 1. The developing process is an assortment of normal development in which a reversely polarized toner adheres to the charges by the Coulomb force and of reverse development in which the toner adheres by bias voltage to the charges lost due to exposure to the light. The development process in the present invention applies to either method, but the case of the normal development is illustrated in FIG. 5.

In the transfer and fixing process, the transfer and the fixing are simultaneously carried out on the surface of the heat-resistant photoconductive film belt 1. Specifically, the visible image formed by adhering the toner onto the heat-resistant photoconductive film belt is conveyed to the transfer and the fixing station. On the other hand, the recording medium 6, such a recording paper, is conveyed to the transfer and the fixing station by conveying means, such as a conveyor belt 11, synchronizing with the initial end of the visible image.

At the transfer and the fixing portion, the transfer and the fixing are simultaneously carried out by inserting the heat-resistant photoconductive film belt 1 and the recording medium 6 between the heat roller 4 and the pressure roller 5, thereby pressure-welding the toner adhered onto the heat-resistant photoconductive film belt, onto the recording medium 6. Alternatively, the transfer and the fixing are simultaneously carried out by heating the toner adhered on this heat-resistant photoconductive film belt in advance by heating means for preheating the toner while conveying to the transfer and fixing station, treating it to an extent that the shell of the encapsulated toner can be easily dissociated, and then inserting the recording medium 6 together with the heat-resistant photoconductive film belt 1 between the pair of pressure rollers 5*a*, 5*b*.

In either case where the heat roller 4 is used or where the toner adhered onto the heat-resistant photoconductive film belt is preheated, the toner surface is heated usually to a temperature range of 40° to 120° C. As described above, although the fixing temperature is set to be up to 120° C., a sufficient fixing strength can be obtained with a nip pressure of normally less than 4 kg/cm, and even less than 2 kg/cm in many cases.

In the present invention, since substantially all of the toner is transferred to the recording medium, a toner collecting device is not required. Incidentally, although trace amounts of the toner may remain on the surface of the heat-resistant photoconductive film belt after the transferring and fixing of the toner to the recording medium 6, this toner can be removed by pressure-welding the heat-resistant photoconductive film belt with such devices as a cleaning web arranged adjacent to the heat roller 4 or the pressure roller 5*a*, making it possible to repeatedly use the heat-resistant photoconductive film belt.

The toner for the present invention include not only insulating encapsulated toners but also conductive encapsulated toners. As described above, as the encapsulated toner for the present invention, a large variety of encapsulated toners are conceivable, and as long as they are within the range of the required thermal properties, there are no limitations on what production process or materials are used, depending on the raw materials and production method. Specifically, those having thermal properties capable of melting the toner by the heat roller or the preheating means described above by heating in a temperature range of 40° C. to 120° C. and easily transferring and fixing by pressure-welding with the pressure roller are chosen.

In addition, the present invention is not confined to the above-mentioned embodiments, and specifications of the kinds of individual apparatus, processes, etc. can be revised based on the principles of the present invention.

By using the method of forming fixed images of the present invention, the following effects can be obtained:

(1) Since the transfer efficiency of the toner to the paper is extremely high, the production of disposed or residual toner is not likely to take place. Accordingly, the extra space is not necessary for collecting the disposed toner, thereby conserving in its maintenance and keeping its environment clean;

(2) Since the trace amounts of the toner, which is adhered to the heat-resistant photoconductive film belt, is removed in a molten state by a cleaning device, the removing efficiency is much improved, and the surface of the photoconductive film is not likely to be damaged;

(3) Since the fixing is carried out at a fixing temperature of not more than 120° C., the fixing device can be simplified, making it possible to miniaturize the fixing device and lower the cost;

(4) Since the fixing is carried out at a fixing temperature of not more than 120° C., heat-resistant members which have been required for the conventional devices are not required for the fixing device and the periphery thereof in the present invention, making it possible to use less expensive materials and lower the cost;

(5) Since the fixing is carried out at a fixing temperature of not more than 120° C. with a low nip pressure, paper sheets become less likely to curl or jam, and thus conserving in its maintenance;

(6) Since the fixing is carried out at a fixing temperature of not more than 120° C. with a lower nip pressure, durability of the components of the fixing device and the periphery thereof becomes longer, and thus conserving in its maintenance;

(7) Since a toner for the low-temperature fixing is used, the temperature of the heating element in the fixing device can be set low with only a small rise of the temperature in the printing machine. Accordingly, a forced radiation device such as an electric fan can be made smaller or a honeycomb-type radiator can be used for radiation, thereby reducing the noise problem;

(8) Since the waiting time for the temperature rise in the fixing device can be shortened, quick printing is made possible;

(9) Since the transfer and the fixing are simultaneously carried out and the fixing is carried out at a low nip pressure, a high quality image can be obtained because the spots on the visible images due to the scattering of the toner, the low line resolution and the blur of the visible images are not likely to take place.

PREFERRED EMBODIMENTS

EXAMPLES

The present invention is hereinafter described in more detail by means of the following working examples, but the present invention is not limited by them.

Production Example of Encapsulated Toner

To a mixture comprising 70.0 parts by weight of styrene, 30.0 parts by weight of 2-ethylhexyl acrylate and 1.0 part by weight of divinylbenzene, 10.0 parts by weight of carbon black "#44" (manufactured by Mitsubishi Kasei, Ltd.), 4.0 parts by weight of 2,2'- azobisisobutyronitrile, 9.5 parts by weight of 4,4'-diphenylmethane diisocyanate "Millionate MT" (manufactured by Nippon Polyurethane Industry Co., Ltd.) are added. The obtained mixture is introduced into an attritor (manufactured by Mitsui Miike Kakoki) and dispersed at 10° C. for 5 hours to give a polymerizable composition. This composition is added to 800 g of a 4% by weight aqueous colloidal solution of tricalcium phosphate which had been preliminarily prepared in a 2-liter separable glass flask, so as to give a concentration of 30% by weight. The obtained mixture is emulsified and dispersed with a TK homomixer (manufactured by Tokushu Kika Kogyo) at 5° C. and a rotational speed of 10000 rpm for 2 minutes. A four-necked glass cap is set on the flask, and a reflux condenser, a thermometer, a dropping funnel fitted with a nitrogen inlet tube and a stainless steel stirring rod are set thereon. The resulting flask is placed on an electric mantle heater. A solution of 22.0 g of resorcinol, 3.6 g of diethyl malonate and 0.5 g of 1,4-diazabicyclo[2.2.2]octane in 40 g of ion-exchanged water is prepared, and the resulting mixture is dropped into the flask in a period of 30 minutes through the dropping funnel while stirring. Thereafter, the contents are heated to 80° C. and reacted for 10 hours in a nitrogen atmosphere while stirring. After cooling the reaction mixture, it is dissolved into 10%-aqueous hydrochloric acid. The resulting mixture is filtered and the obtained solid is washed with water, dried under a reduced pressure of 20 mmHg at 45° C. for 12 hours and classified with an air classifier to give the encapsulated toner with an average particle size of 9 μm having a shell made of a resin having a thermally dissociating urethane linkage. The glass transition point assignable to the resin contained in the core material is 30.2° C., and its softening point is 130.0° C.

Production Example of Reference Toner

To 100 parts by weight of a polyester resin (Bisphenol-type polyester resin; softening point: 135° C.; Tg: 65° C.), 7 parts by weight of carbon black (manufactured by Mitsubishi Kasei Ltd., MA8), 3 parts by weight of a polypropylene wax (Sanyo Kasei Ltd., Biscol 660P), and 2 parts by weight of a charge control agent (Hodogaya Kagaku Ltd., Aizenspilon Black TRH) are mixed, and the resulting mixture is kneaded by a pressurized kneader. After sufficiently dispersing the obtained mixture, it is pulverized with a pulverizing mill and then classified with a classifier to obtain a toner having a particle distribution range of 5 to 25 μm and an average particle size of 10 μm. To 1 kg of the toner, 5 g of colloidal silica (Nihon Aerozil Ltd.: R972) is externally added to obtain a surface-treated reference toner.

Test Example 1

50 g of the toner obtained in Production Example of Encapsulated Toner is blended together with 1 kg of a commercially available ferrite carrier by using a V-type blender to obtain a developer 1. The obtained developer 1 is loaded on a modified apparatus of a commercially available copying machine having width of 440 mm, length of 450 mm and height of 250 mm to test its fixing ability. Specifically, a fixing device of the present invention schematically shown in FIG. 1 comprises a heat-resistant film belt comprising a charge generation layer containing phthalocyanine dye and a charge transport layer containing arylamine derivative, a heat roller having a diameter of 20 mm and a nip pressure being set at 0.3 kg/cm, and a cleaning web made of a polyamide non woven fabric being arranged opposite to the heat roller as shown in FIG. 1 as a cleaning device. The modified apparatus can be miniaturized to about not more than $\frac{2}{3}$ of the commercially available copying machine, when calculated based on the void ratio. The fixing ability and the non-offsetting region of the toner of the present invention are measured using the above fixing device, while varying the heating temperature at a linear velocity of 40 mm/sec. As a result, the lowest fixing temperature is 100° C., and the non-offsetting region of the toner is at a temperature between 90° C. and 180° C.

On the other hand, the toner obtained by the Production Example of Reference Toner is mixed with a commercially available ferrite carrier to prepare a developer 2. The fixing ability and the non-offsetting region of the reference toner are measured using the fixing device in the same manner as above. As a result, the lowest fixing temperature is 145° C., and the non-offsetting region of the toner is at a temperature of not less than 130° C.

Test Example 2

The developer 1 obtained in Test Example 1 is loaded on a modified apparatus of a commercially available copying machine having width of 400 mm, length of 350 mm and height of 250 mm to test its fixing ability. Specifically, a fixing device of the present invention schematically shown in FIG. 2 comprises the same heat-resistant film belt as in Test Example 1, a pressure roller having a diameter of 20 mm, a quartz heater lamp preheating to a temperature of 100° to 170° C. as a heater, the nip pressure being set at 0.3 kg/cm, and a cleaning web made of a polyamide non woven fabric being arranged opposite to the pressure roller as shown in FIG. 2 as a cleaning device. The modified apparatus can be miniaturized to about not more than $\frac{3}{4}$ of the commercially available copying machine, when calculated based on the void ratio. The fixing ability and the non-offsetting region of the toner of the present invention are measured using the fixing device, while varying the heating temperature at a linear velocity of 25 mm/sec. As a result, the lowest fixing temperature is 95° C., and the non-offsetting region of the toner is at a temperature between 90° C. and 160° C.

On the other hand, by using the developer 2 obtained in the Test Example 1, the fixing ability and the non-offsetting region of the reference toner are measured using the fixing device in the same manner as above. As a result, the lowest fixing temperature is 140° C., and the non-offsetting region of the toner is at a temperature of not less than 120° C.

The lowest fixing temperature for the toner is the temperature of the paper surface at which the fixing rate of the toner exceeds 70%. This fixing rate of the toner is determined by placing a load of 500 g on a sand-containing rubber eraser having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Co., and then calculating the fixing rate from this density value and a density value before the eraser treatment using the following equation.

$$\text{Fixing rate} = \frac{\text{Image density after eraser treatment}}{\text{Image density before eraser treatment}} \times 100$$

Image density before eraser treatment

Test Example 3

Using the modified fixing device described in Test Example 1, continuous copying test is carried out for 3000 copies with the developer 1 obtained in Test Example 1 by properly adjusting the fixing temperature to fall in the range of between 100° to 130° C. at a linear velocity of 40 mm/sec. As a result, good fixing ability is shown and the curling, the jamming of the papers does not take place. In addition, the cleaning web shows substantially no spots due to the residual toner.

On the other hand, the same continuous copying test is carried out for 100 copies with the developer 2 obtained in Test Example 1. As a result, its image quality is extremely lowered because sufficient fixing to the paper cannot be achieved and the cleaning web showed a large number of spots due to the residual toner, and further a large number of spots on the photoconductive film is shown.

Test Example 4

The continuous copying test is carried out for 3000 copies in the same manner as in Test Example 3 except that the modified apparatus shown in Test Example 2 is used. The similar results are obtained as in Test Example 3.

From these test examples, it is confirmed that by utilizing the method of forming fixed images according to the present invention, while remarkably miniaturizing the fixing device when compared to the commercially available copying machines, the fixing ability of the present invention is good and the lowest fixing temperature is lowered. This is particularly remarkable in a case where a thermally dissociating encapsulated toner is used. Further, as is clear from the fact that substantially no spots are observed on the cleaning web after a continuous copying test, the transfer efficiency is extremely good, and thereby no extra space is necessary for collecting the residual toner, making it highly advantageous in miniaturizing the copying machine.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of forming fixed images comprising uniformly charging a heat resistant photoconductive film belt;

selectively exposing said heat resistant photoconductive film belt to light to form an electrostatic latent image;

developing said electrostatic latent image whereby an encapsulated toner is applied to said electrostatic latent image formed on said heat resistant photoconductive film belt to form a visible image;

transferring said formed visible toner image to a recording medium; and fixing said transferred visible toner image onto said recording medium, wherein said transferring and fixing process steps are simultaneously carried out on said heat-resistant photoconductive film belt at a temperature of from 40° to 120° C.

2. The method according to claim 1, wherein said heat-resistant photoconductive film belt comprises a photoconductor selected from the group consisting of a silicon photoconductor, a zinc oxide photoconductor and an organic photoconductor in a binder, wherein said binder for said photoconductor has a glass transition point of not less than 100° C.

3. The method according to claim 1, wherein said heat-resistant photoconductive film belt and said recording medium are inserted simultaneously between a heat roller and a pressure roller in the transfer and fixing of said visible toner image.

4. The method according to claim 3, further including a cleaning device juxtapositioned to said heat roller.

5. The method according to claim 1, wherein said visible toner image to be transferred to said recording medium is preheated while on said heat-resistant photoconductive film belt, and following preheating of said visible toner image, said heat-resistant photoconductive film belt and said recording medium are inserted simultaneously between two pressure rollers in the transfer and fixing of said visible toner image.

6. The method according to claim 5, further including a cleaning device juxtapositioned to at least one of said pressure rollers.

7. The method according to claim 5, wherein said visible toner image is preheated to a temperature of from 40° to 120° C.

8. The method according to claim 1, wherein a nip pressure during said simultaneous image transfer and fixing is from 0.1 to 4 kg/cm.

9. The method according to claim 1, wherein said encapsulated toner comprises a heat-fusible core material containing at least a coloring agent and a shell formed thereon so as to cover the surface of the core material, wherein the main component of the shell is a resin prepared by reacting:

(A) an isocyanate and/or isothiocyanate compound comprising:

(1) 0 to 30 mol % of a monovalent isocyanate and/or isothiocyanate compounds, and (2) 100 to 70 mol % of at least a divalent isocyanate and/or isothiocyanate compounds with (B) an active hydrogen compound comprising:

(3) 0 to 30 mol % of a compound having one active hydrogen atom reactive with the isocyanate and/or isothiocyanate groups and (4) 100 to 70 mol % of a compound having at least two active hydrogen atoms reactive with the isocyanate and/or isothiocyanate groups at a molar ratio of the component (A) to the component (B) of between 1:1 and 1:20, and wherein at least 30% of all of the linkages formed from the isocyanate or isothiocyanate groups are thermally dissociating linkages.

10. The method according to claim 9, wherein said thermally dissociating linkages are derived from reacting phenolic hydroxyl and/or thiol groups with the isocyanate and/or isothiocyanate groups.

11. The method according to claim 9, wherein said heat-fusible core material comprises a thermoplastic resin as its main component, whose glass transition point is 10° C. to 50° C.

12. The method according to claim 9, wherein the softening point of said encapsulated toner is from 80° to 150° C.

* * * * *